US007207783B2

(12) United States Patent
Uchino

(10) Patent No.: US 7,207,783 B2
(45) Date of Patent: Apr. 24, 2007

(54) VARIABLE DISPLACEMENT PUMP

(75) Inventor: Kazuyoshi Uchino, Saitama (JP)

(73) Assignee: Unisia JKC Steering Systems Co., Ltd., Kanagawa (JP)

( * ) Notice: Subject to any disclaimer, the term of this patent is extended or adjusted under 35 U.S.C. 154(b) by 86 days.

(21) Appl. No.: 11/203,138

(22) Filed: Aug. 15, 2005

(65) Prior Publication Data

US 2006/0034721 A1 Feb. 16, 2006

Related U.S. Application Data

(62) Division of application No. 10/359,279, filed on Feb. 6, 2003, now Pat. No. 6,976,830.

(30) Foreign Application Priority Data

Aug. 31, 2001 (JP) ..... 2001-263663

(51) Int. Cl.
*F04B 49/00* (2006.01)
*F04C 14/18* (2006.01)

(52) U.S. Cl. ..... 417/220; 418/26; 418/144

(58) Field of Classification Search ..... 417/220; 418/24–27, 144, 30

See application file for complete search history.

(56) References Cited

U.S. PATENT DOCUMENTS 5,518,380 A * 5/1996 Fujii et al. ..... 418/26
5,538,400 A 7/1996 Konishi et al.
6,042,343 A 3/2000 Semba et al.
6,155,797 A 12/2000 Kazuyoshi
6,217,296 B1 4/2001 Miyazawa et al.
6,280,150 B1 8/2001 Miyazawa
6,352,415 B1 3/2002 Uchino
6,616,419 B2 * 9/2003 Watanabe et al. ..... 417/220
6,709,242 B2 * 3/2004 Mochiyama et al. ..... 417/220

FOREIGN PATENT DOCUMENTS

DE 2015744 10/1971
DE 3214688 A1 11/1982

* cited by examiner

*Primary Examiner*—Charles G. Freay
(74) *Attorney, Agent, or Firm*—Sughrue Mion, PLLC

(57) ABSTRACT

Within a cam ring (8), a rotor having a plurality of vanes (27) is eccentrically disposed. A metering orifice (136) is provided halfway on a discharge passage (135) of pressure fluid discharged from the pump, and a control valve is activated due to a pressure difference between the upstream and downstream sides of the metering orifice (136). A fluid pressure of the first fluid pressure chamber (21) is controlled by activation of the control valve (123). The second fluid pressure chamber (22) is shut off from the control valve (123) to introduce a pressure on the suction side at any time. To return the cam ring (8) in a direction of expanding a pump chamber (11), an internal pressure of the cam ring (8) is applied in the return direction.

2 Claims, 13 Drawing Sheets

VARIABLE DISPLACEMENT PUMP

This is a divisional of application Ser. No. 10/359,279 filed Feb. 6, 2003 now U.S. Pat. No. 6,976,830. The entire disclosure(s) of the prior application(s), application number(s) Ser. No. 10/359,279 is hereby incorporated by reference.

The present disclosure relates to the subject matter contained in Japanese Patent Application No. 2001-263663 filed on Aug. 31, 2001, which are incorporated herein by reference in its entirety.

BACKGROUND OF THE INVENTION

1. Field of the Invention

The present invention relates to a variable displacement pump for use as a hydraulic pressure supply source for an automobile power steering device, for example.

2. Description of the Related Art

A variable displacement pump according to the related art of this kind is well known in which the discharge flow rate is controlled by increasing or decreasing the volume of a pump chamber, as disclosed in JP-A-6-200883, for example. Referring to FIGS. 9 to 12, the variable displacement pump disclosed in this publication will be described below.

FIG. 9 is a cross-sectional view of a variable displacement pump according to the related art, taken perpendicularly to an axial line of a drive shaft. FIG. 10 is a cross-sectional view of the variable displacement pump according to the related art, taken along the axial line of the drive shaft. FIGS. 11 and 12 are cross-sectional views showing the constitution of a control valve and a discharge passage. In these figures, reference numeral 2 denotes a pump body of the variable displacement pump (indicated by numeral 1 as a whole), which has a front body 4 like a cup located on the left of FIG. 10 and a rear body 5 like a plate located on the right of FIG. 10.

The front body 4 has a circular concave portion 6 opening to the right of FIG. 10, in which the pump components including a pressure plate 7, a cam ring 8, a rotor 3 and an adapter ring 9 are inserted within this concave portion 6. A circular convex portion 5*a* formed on a front face of the rear body 5 is fitted into an opening portion of this front body 4, and the front body 4 and the read body 5 are secured by a securing bolt 10 to close the circular concave portion 6 of the front body 4. The circular convex portion 5*a* of the rear body 5 constitutes one side wall of the pump chamber 11 as will be described later, and owing to an O-ring 12 attached around an outer circumferential face thereof, a pressure oil is prevented from leaking out of the pump body 2.

The pressure plate 7 disposed on the bottom side of the circular convex portion 6 for the front body 4 has a circular plate portion 7*a* making up the other side wall of the pump chamber 11 and a cylindrical portion 7*b* formed in an axial core of this circular plate portion 7*a*, in which this circular plate portion 7*a* is fitted with the inner circumferential face of the circular concave portion 6 of the front body 4. An O-ring 13 is attached around the outer circumference of this circular plate portion 7*a* to prevent pressure oil from leaking through a gap between the circular plate portion 7*a* and the front body 4. The pressure plate 7 is disposed on the bottom face side of the circular concave portion 6 of the front body 4. The adapter ring 9 is fitted on the outer circumferential portion of the pressure plate 7. The cam ring 8 and the rotor 3 are contained inside this adapter ring 9.

The cam ring 8 acts to increase or decrease the pump volume of the variable displacement pump 1, and is carried by the adapter ring 9 to be swingable around a seal pin 14 provided on inner circumference of the adapter ring 9 and on the lower side in FIG. 9 as a swinging fulcrum. Also, the cam ring 8 is urged on the left of FIG. 9 by urging means 15. This urging means 15 has a plug 16 screwed into the front body 4, and a compression coil spring 17 resiliently attached between the plug 16 and the cam ring 8. This compression coil spring 17 is inserted through a through hole 9*a* formed in the adapter ring 9 to contact with the cam ring 8.

The cam ring 8 is swung reciprocatively by supplying pressure oil from a control valve 23 selectively to a first fluid pressure chamber 21 formed in one swing direction (on the left of FIG. 9) or a second fluid pressure chamber 22 formed in the others wing direction. The first fluid pressure chamber 21 and the second fluid pressure chamber 22 are partitioned with the seal pin 14 and a seal member 24 attached at a position in axial symmetry to the seal pin 14 of the cam ring 8. Sealing between both the fluid pressure chambers 21 and 22 is kept by the seal pin 14 and the seal member 24.

The rotor 2 disposed inside the cam ring 8 is connected to a drive shaft 25 having a motive power transmitted from an engine, not shown, and has a plurality of vanes 27 carried to be able to emerge from its outer circumference and sliding with an inner circumferential cam face of the cam ring 8. The drive shaft 25 for rotating the rotor 3 is rotatably supported via the bearings 28, 29 and 30 within the pump body 2. The rotor 3 is rotated by the drive shaft 25 in a counterclockwise direction (as indicated by the arrow) in FIG. 9.

This variable displacement pump 1 sucks a working oil from a suction pipe 31 and a suction passage 31*a*, which are fixed to the rear body 5, through a suction opening 32 formed in the convex portion 5*a* of the rear body 5 into the pump chamber 11, as shown in FIG. 10. Also, the working oil sucked into the pump chamber 11 is discharged through a discharge opening 33 formed in the circular plate portion 7*a* of the pressure plate 7 to a discharge pressure chamber 34 formed on the bottom of the front body 4. The discharge flow rate of this variable displacement pump 1 is at maximum in a state where the cam ring 8 is swung on the left as shown in FIG. 9 and decreases when the cam ring 8 is swung on the right of FIG. 9.

The discharge pressure chamber 34 is formed annularly between the outer circumference of the cylindrical portion 7*b* of the pressure plate 7 and the bottom face of the circular concave portion 6. The discharge passage 35 is connected to an upper portion of the discharge pressure chamber 34 in FIG. 10. A pressure oil discharged from the pump chamber 11 to the discharge pressure chamber 34 is fed through this discharge passage 35 to a power steering device PS. The discharge passage 35 has a radial portion 35*a* extending from the discharge pressure chamber 34 outwards in the radial direction of the rotor 3, and a transversal portion 35*b* extending in a direction orthogonal to this radial portion 35*a*, as shown in FIG. 10. A feed oil pipe (not shown) for feeding pressure oil to the power steering device PS is connected to an end portion of this transversal portion 35*b*. Also, the transversal portion 35*b* of the discharge passage 35 is provided with a metering orifice 36 (see FIG. 11).

The control valve 23 has a spool 38 fitted slidably within a valve bore 37 formed in the front body 4. The spool 38 partitions the inside of the valve bore 37 into the first to fourth oil chambers 41 to 44, and is biased on the left of FIGS. 11 and 12 by a compression coil spring 45 disposed in a fourth oil chamber 44. The first oil chamber 41 is always connected via a communication passage 46 to an upstream side of the metering orifice 36 provided in the transversal portion 35*b* of the discharge passage 35. The second oil chamber 42 is connected via communication passages 47 and 48 (see FIG. 10) to the suction opening 32 of the rear body 5.

A third oil chamber 43 is connected through a communication passage 50 to the upstream side of the metering orifice 36 in a state where the spool 38 is pressed by the compression coil spring 45 and abutted against a stopper 49 as shown in FIG. 11. The fourth oil chamber 44 is connected through a communication passage 51 to the downstream side of the metering orifice 36. Also, the fourth oil chamber 44 is connected via a relief valve 52 provided within the spool 38 to the second oil chamber 42, as shown in FIG. 9.

The valve bore 37 of the control valve 23 is connected through a first connecting passage 53 to the first fluid pressure chamber 21, and through a second connecting passage 54 to the second fluid pressure chamber 22, as shown in FIG. 9 opening positions of the connecting passages 53 and 54 on the side of the valve bore 37 are set such that the first connecting passage 53 is connected to the second oil chamber 42 and the second connecting passage 54 is connected to the third oil chamber 43 in a state where the spool 38 is abutted against the stopper 49, as shown in FIG. 11, or the first connecting passage 53 is connected to the first oil chamber 41 and the second connecting passage 54 is connected to the second oil chamber 42 in a state where the spool 38 is moved on the right, as shown in FIG. 12.

In the variable displacement pump 1 according to the related art having the above constitution, when the engine speed is in a range of low rotating speed including idling (range of A to B in FIG. 13), the spool 38 of the control valve 23 is pressed against the stopper 49 by a resilient force of the compression coil spring 45, as shown in FIG. 11. Because a pressure difference between the upstream side and the downstream side of the metering orifice 36 is small.

In this state, a pressure in the suction opening 32 is applied from the second oil chamber 42 of the control valve 23 to the first fluid pressure chamber 21, and a discharge pressure (an upstream pressure of the metering orifice 36) is applied from the third oil chamber 43 to the second fluid pressure chamber 22. Thereby, the cam ring 8 is held at a position as shown in FIG. 9, so that the pump volume of the pump chamber 11 formed between the rotor 3 and the cam ring 8 is at maximum and the discharge flow rate is also at maximum.

If the engine speed is increased and the flow rate of pressure oil passing through the discharge passage 35 is increased, there is a greater pressure difference between the upstream side and the downstream side of the metering orifice 36. Along with the increased pressure on the upstream side of the metering orifice 36, the pressure of the first oil chamber 41 in the control valve 23 is increased, so that the spool 38 is moved on the right against the resilient force of the compression coil spring 45, as shown in FIG. 12. Consequently, a discharge pressure is applied from the first oil chamber 41 to the first fluid pressure chamber 21, and a pressure of the suction opening 32 is applied from the second oil chamber 42 to the second fluid pressure chamber 22. Therefore, the cam ring 8 is swung on the right of FIG. 9 against a resilient force of the compression coil spring 17 of the urging means 15, decreasing the volume of the pump chamber 11 to make the discharge flow rate constant. During fast driving (C point in FIG. 13) where the cam ring 8 is swung up on the right end of FIG. 9, the discharge flow rate is constant at minimum.

The variable displacement pump 1 according to the related art having the above constitution has a problem that the energy loss amount is increased in a running state with great discharge flow rate, and it is found that this problem is caused by leakage of the pressure oil. That is, at the low rotating speed (in a range of A to B in FIG. 13), a pressure on the upstream side of the metering orifice 36 is introduced into the second fluid pressure chamber 22, and a high pressure oil supplied to the second fluid pressure chamber 22 at this low rotating speed is flowed through a small annular gap outside the adapter ring 9 into the first connecting passage 53 to leak into the second oil chamber 42 with lowest pressure within the control valve 23. By this amount of leakage, the pressure oil discharged from this variable displacement pump 1 is decreased. Hence, to make up for this amount of leakage, the engine speed must be increased to increase the discharge flow rate, resulting in the greater energy loss amount as previously described.

The small annular gap through which pressure oil is leaked may be composed of a first gap formed between the adapter ring 9 and the front body 4 and a second gap formed along the O-rings 12 and 13 attached to the rear body 5 and the pressure plate 7 to seal the pump chamber 11.

The first gap is formed when the adapter ring 9 or the front body 4 is deformed owing to a pressure oil acting on the outer circumferential face of the adapter ring 9. Into this gap, pressure oil of the second fluid pressure chamber 22 is leaked through the through hole 9*a* for the urging means 15 of the adapter ring 9 or an interstice formed between the rear body 5 and the pressure plate 7. To prevent pressure oil from leaking through the first gap, a structure is taken in which the cam ring is directly attached to the front body 4 without the use of the adapter ring 9. However, to adopt this structure, the front body 4 must be divided and formed at as high a precision as the adapter ring 9, increasing the costs remarkably.

On one hand, the second gap is formed when the O-rings 12 and 13 attached to the rear body 5 and the pressure plate 7 are pressed and compressed by a hydraulic pressure of the second fluid pressure chamber 22 to widen the space within the O-ring receiving portions 12*a* and 13*a* (see FIG. 10). To prevent pressure oil from leaking through the second gap, the fitting portion of the front body 4 and the rear body 5, the pressure plate 7 must be formed to make the gap as narrow as possible to prevent pressure oil from acting on the O-ring receiving portions 12*a* and 13*a*, resulting in the increased costs.

Also, in the variable displacement pump 1 according to the related art, a discharge pressure is always applied to the second fluid pressure chamber 22 during the period of low rotating speed, resulting in a problem that the pump body 2 must be formed securely and increased in size.

Thus, JP-A-2002-98060, which has been filed by Applicant, discloses a variable displacement pump, which can discharge pressure oil efficiently by preventing leakage of pressure oil from inside the pump while reducing the costs.

The variable displacement pump having a cam ring carried swingably inside an adapter ring, a first fluid pressure chamber provided in one of the swing directions of the cam ring, a second fluid pressure chamber provided in the other swing direction of the cam ring, urging means for urging the cam ring in a direction to maximize the volume of pump chamber, and a control valve for controlling the hydraulic pressure of the fluid pressure chambers on the both sides of the cam ring. The first and second fluid pressure chambers are connected to the control valve to be activated owing to a differential pressure between upstream side and downstream side of a metering orifice provided halfway on a discharge passage. The control valve is provided with a closing portion for closing a port connecting to the second fluid pressure chamber, when the differential pressure between the upstream side and the downstream side of the metering orifice is small.

The variable displacement pump has the advantages that it is possible to prevent pressure oil from leaking via the second fluid pressure chamber through the gap inside the pump, because no pressure oil is flowed into the second fluid pressure chamber at the low rotating speed. There is no need of increasing the size of the pump body for greater strength, because no discharge pressure is always applied on the second fluid pressure chamber.

SUMMARY OF THE INVENTION

The present invention has further improvements on the variable displacement pump disclosed in JP-A-2002-98060. It is an object of the invention to provide a variable displacement pump in which a passage hole is made unnecessary, which is formed inside the pump body or in the adapter ring and connects the control valve and the second fluid pressure chamber, without impairing the restorability to the side for increasing the volume of pump chamber. The number of working steps is decreased. No high pressure is applied on the second fluid pressure chamber even momentarily. The pump can be used for higher pressures without increasing the size of the pump body.

According to a first aspect of the invention, there is provided a variable displacement pump having a cam ring carried swingably between plates on both sides, a first fluid pressure chamber formed in one of the swing directions of the cam ring, a second fluid pressure chamber provided in the other swing direction of the cam ring, urging means for urging the cam ring toward the first fluid pressure chamber, disposed on a side of the second fluid pressure chamber, a rotor eccentrically disposed within the cam ring and having a plurality of vanes on an outer circumference thereof, a metering orifice disposed halfway on a discharge passage of a pressure fluid discharged from a pump, and a control valve activated by a pressure difference between upstream and downstream sides of the metering orifice. A fluid pressure in at least one of the first and second fluid pressure chambers is controlled by activation of the control valve to swing the cam ring. The first fluid pressure chamber is connected to the control valve to control a fluid pressure in the first fluid pressure chamber. The second fluid pressure chamber is shut off from the control valve and connected to a pump suction side at any time. An internal pressure of the cam ring is applied in the one of the swing directions of the cam ring.

In the variable displacement pump according to the invention, a pressure on the pump suction side is introduced into the second fluid pressure chamber at any time by dispensing with the oil passage from the control valve to the second fluid pressure chamber, whereby no high pressure is applied, vibration sound due to internal leakage or pulsation is improved, and it is unnecessary to increase the size of the pump body for greater strength. And to return the cam ring in a direction of maximizing the pump volume, an internal force of the cam ring, is set in the return direction, in addition to a spring force, whereby the cam ring can be returned in stable and rapid operation.

According to a second aspect of the invention, there is provided a variable displacement pump having a cam ring carried swingably between plates on both sides, a first fluid pressure chamber formed in one of the swing directions of the cam ring, a second fluid pressure chamber provided in the other swing direction of the cam ring, urging means for urging the cam ring toward the first fluid pressure chamber, disposed on a side of the second fluid pressure chamber, a rotor eccentrically disposed within the cam ring and having a plurality of vanes on an outer circumference thereof, a metering orifice disposed halfway on a discharge passage of a pressure fluid discharged from a pump, and a control valve activated by a pressure difference between upstream and downstream sides of the metering orifice. A fluid pressure in at least one of the first and second fluid pressure chambers is controlled by activation of the control valve to swing the cam ring. The first fluid pressure chamber is connected to the control valve to control a fluid pressure in the first fluid pressure chamber. The second fluid pressure chamber is shut off from the control valve and connected to a pump suction side at any time. A rolling support face for carrying the cam ring swingably is disposed on the side of the second fluid pressure chamber off a shaft center of the rotor and inclined toward the first fluid pressure chamber.

According to a third aspect of the invention, positions of a terminal end of a suction opening and a start end of a discharge opening, which are formed in the plates disposed on both sides of the cam ring, are shifted circumferentially by rotating toward the suction opening. The cam ring is deviated toward the suction opening to apply an internal pressure of the cam ring to the first fluid pressure chamber.

According to a fourth aspect of the invention, there is provided a variable displacement pump having a cam ring carried swingably between plates on both sides, a first fluid pressure chamber formed in one of the swing directions of the cam ring, a second fluid pressure chamber provided in the other swing direction of the cam ring, urging means for urging the cam ring toward the first fluid pressure chamber, disposed on a side of the second fluid pressure chamber, a rotor eccentrically disposed within the cam ring and having a plurality of vanes on an outer circumference thereof, a metering orifice disposed halfway on a discharge passage of a pressure fluid discharged from a pump, and a control valve activated by a pressure difference between upstream and downstream sides of the metering orifice. A fluid pressure in at least one of the first and second fluid pressure chambers is controlled by activation of the control valve to swing the cam ring. A discharge opening for discharging a pressure fluid from a pump chamber is disposed on one of the plates for carrying the cam ring. A first seal ring surrounding a drive shaft for driving the rotor and a second seal ring on an outer circumference of the first seal ring, surrounding a wider region than a region where the discharge opening is disposed are provided on a rear face of the other plate. An inlet passage for introducing a discharge pressure is formed in an area between the first and second seal rings.

According to the above inventions, by introducing a discharge pressure between the inner and outer seal rings provided on one plate, the plate, the cam ring, the rotor, the adapter ring and the discharge opening are pressed onto the other plate, so that the side clearance is reduced as the pump discharge pressure is higher, thereby preventing the pump efficiency from decreasing due to internal leakage.

According to a fifth aspect of the invention, the first and second seal rings are made of resin. The first and second seal rings communicate to seal grooves to which the seal rings are fitted. Concave portions, which are deeper than the seal grooves, are formed to introduce a discharge pressure thereinto.

According to the above invention, the seal rings made of resin are supported from the back side by high pressure oil introduced into the concave portion, whereby the blow-by phenomenon can be prevented.

DETAILED DESCRIPTION OF THE PREFERRED EMBODIMENTS

Figure 1:
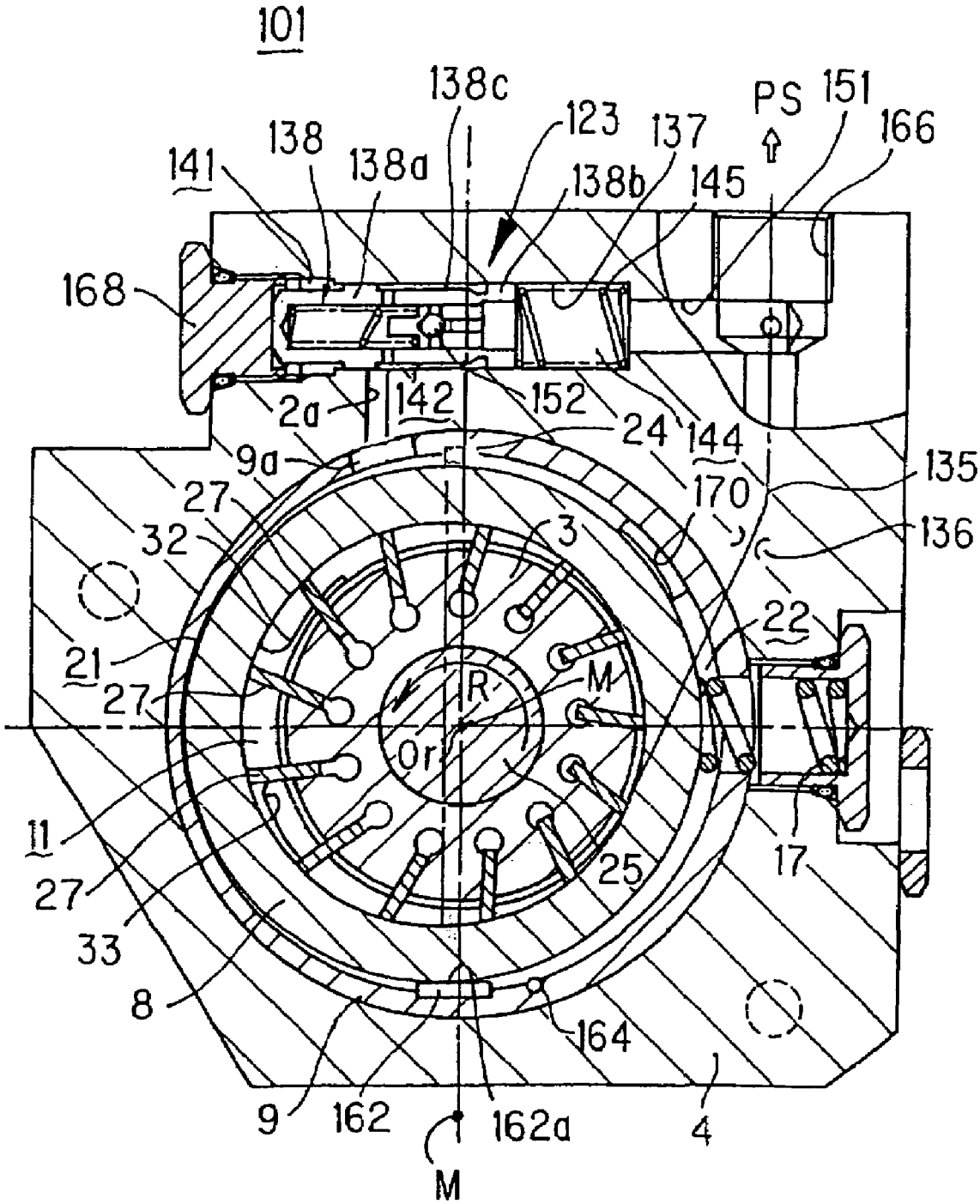
FIG. 1 is a cross-sectional view of a variable displacement pump according to one embodiment of the present invention, taken perpendicularly to the axial line of a drive shaft.
Figure 2:
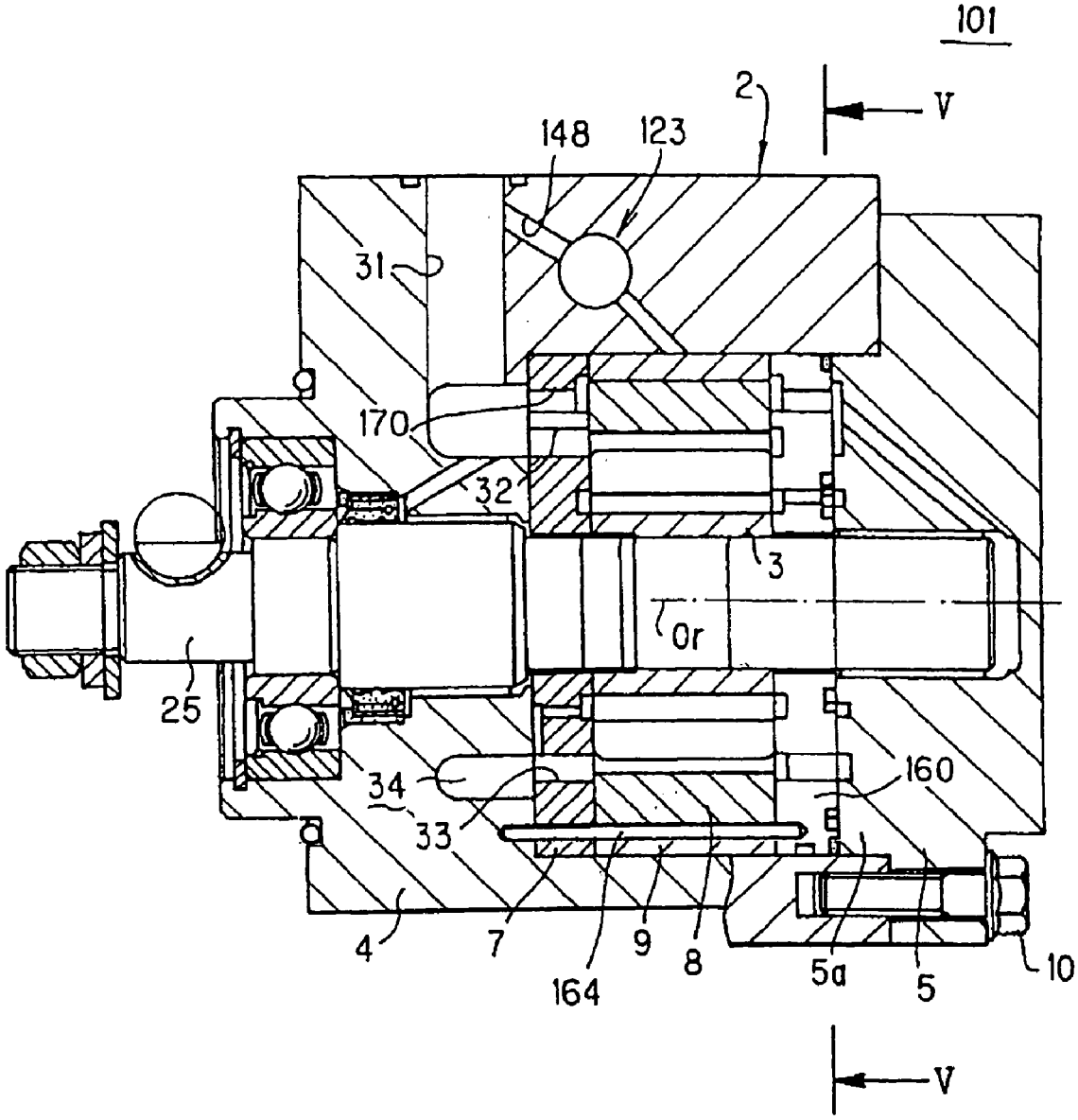
FIG. 2 is a cross-sectional view of the variable displacement pump taken along the axial line of the drive shaft.

The preferred embodiments of the present invention will be described below with reference to the accompanying drawings. FIG. 1 is a cross-sectional view of a variable displacement pump according to one embodiment of the present invention, taken perpendicularly to an axial line of a drive shaft. FIG. 2 is a cross-sectional view of the variable displacement pump taken along the axial line of the drive shaft. The same or like parts are designated by the same numerals as those of the constitution according to the related art as previously described and shown in FIGS. 9 to 12, and not detailed anymore.

This variable displacement pump (numeral 101 as a whole) is employed as a hydraulic pressure supply source of a power steering device for the automobile, in which a motive power of an engine, not shown, is transmitted to a drive shaft 25 to rotate a rotor 3. In this embodiment, the drive shaft 25 and the rotor 3 are rotated in a counterclockwise direction, as indicated by an arrow R in FIG. 1.

This variable displacement pump 101 has a side plate 7, an adapter ring 9, a cam ring 8, the rotor 3, and a pressure plate 160 inserted in this order from the bottom side of the front body 4 in a pump body 2 in which a front body 4 and a rear body 5 are abutted to each other. A circular projection 5*a* of the rear body 5 is inserted into an opening portion of the front body 4, and fixed by a bolt 10.

The rotor 3 is connected to the drive shaft 25, and rotated by a motive power of the engine, as previously described. Also, the cam ring 8 on the outer circumferential side of the rotor 3 within the adapter ring 9 is disposed eccentrically with respect to a rotational center Or of the rotor 3 (shaft center of the drive shaft 25), and carried swingably. On an inner face of the adapter ring 9, a support plate 162 having a rolling support face 162*a* perpendicular to an orthogonal line M passing the rotational center Or of the rotor 3 is disposed. The cam ring 8 is supported by this support plate 162 to be swingable on the left and right of FIG. 1 between the side plate 7 and the cam ring 8. Also, because this support plate 162 is placed, the cam ring 8 is slightly shifted upwards in FIG. 2 (toward a suction opening 32). In this embodiment, the vanes are used as the support plate 162 for supporting the cam ring 8 to be swung, thereby securing the strength of the support face 162 of the cam ring 8 and making a seal between the fluid pressure chambers 21 and 22, as will be described later.

A first fluid pressure chamber 21 (on the left side in FIG. 1) and a second fluid pressure chamber 22 (on the right side in FIG. 1) are formed on the both sides of this cam ring 8 in the swing direction. A seal member 24 is attached at a position in axial symmetry to the support plate 162 of the adapter ring 9. The fluid pressure chambers 21 and 22 are partitioned with the support plate 162 and the seal member 24 tight. When the cam ring 8 is swung on the left in FIG. 1, the volume of the pump chamber 11 formed by two adjacent vanes 27, 27 between the plates 7 and 160 is at maximum. When it is swung on the right, the volume of the pump chamber 11 is reduced. A spring (urging means) 17 is placed on the side of the second fluid pressure chamber 22 to urge the cam ring 8 in a direction where the volume of the pump chamber 11 is maximized at any time. A pin 164 provided near the support plate 162 is a locking pin for locating the side plate 7, the adapter ring 9 and the pressure plate 160.

In an area (suction area upward in FIG. 1) of the side plate 7 where the volume of the pump chamber 11 is gradually expanded along with the rotation of the rotor 3, a circular suction opening 32 is formed to supply a working fluid sucked via a suction passage 31 from the tank to the pump chamber 11. Also, in an area (discharge area downward in FIG. 1) of the side plate 7 where the volume of the pump chamber 11 is gradually reduced along with the rotation of the rotor 3, a discharge opening 33 is opened to introduce a pressure fluid discharged via this discharge opening 33 from the pump chamber 11 into a discharge pressure chamber 34 formed on the bottom of the pump body 2. This discharge pressure chamber 34 is connected via a discharge passage 135 formed in the pump body 2 to a discharge port 166, such that a pressure fluid introduced into the discharge pressure chamber 34 is fed through the discharge port 166 to a power cylinder of the power steering device PS.

Within the pump body 2, a control valve 123 is provided facing a direction orthogonal to the drive shaft 25. This control valve 123 has a spool 138 fitted slidably within a valve bore 137 formed in the pump body 2. This spool 138 is always urged on the left of FIG. 1 (toward the first fluid pressure chamber 21) by a compression coil spring 145 disposed within a chamber 144 (hereinafter referred to as a spring chamber) on one end (of the second fluid pressure chamber 22 on the right in FIG. 1), and is stopped against the front face of a plug 168 screwed into an opening portion of the valve bore 137 to close this valve bore 137, when not activated.

A metering orifice 136 is provided halfway on the discharge passage 135 leading from the pump chamber 11 to the power steering device PS. A fluid pressure upstream of the metering orifice 136 is introduced via a pilot pressure passage, not shown, into a left chamber 141 (hereinafter referred to as a high pressure chamber) in FIG. 1, while a fluid pressure downstream of the metering orifice 135 is introduced via a pilot pressure passage 151, not shown, into the spring chamber 144. If a pressure difference between both the chambers 141 and 144 exceeds a predetermined value, the spool 138 is moved on the right of FIG. 1 against the compression coil spring 145. In this embodiment, the metering orifice 136 is a stationary orifice, but may be a variable orifice as disclosed in JP-A-2002-98060 or JP-A-2002-168179.

The first fluid pressure chamber 21 formed on the left of the cam ring 8 is in communication via the connecting passages 2*a* and 9*a* formed in the pump body 2 and the adapter ring 9 to the high pressure chamber 141 of the valve bore 137. On the other hand, the second fluid pressure chamber 22 formed on the right of the cam ring 8 has no connecting passage provided in the variable displacement pump according to the related art, and is not directly connected to the control valve 123. And this second fluid pressure chamber 22 is in communication via an inlet bore 170 formed in the side plate 7 to the suction passage 31 to introduce a pressure of the suction side at any time.

On the outer circumferential face of the spool 138, a first land portion 138*a* for partitioning the high pressure chamber 141 and a second land portion 138*b* for partitioning the spool chamber 144 are formed. An annular groove portion 138*c* is provided intermediately between both the land portions 138*a* and 138*b*. This intermediate annular groove portion 138*c* is connected via a pump suction passage 148 (see FIG. 2) to the tank. A pump suction chamber 142 is made up of a space between the annular groove portion 138*c* and the inner circumferential face of the valve bore 137.

The first fluid pressure chamber 21 provided on the left of the cam ring 8 is connected via the connecting passages 2*a*, 9*a* to the pump suction chamber 142, when the spool 138 is in the inactive position as shown in FIG. 1. If the spool 138 is activated due to a differential pressure back and forth the metering orifice 136, it is gradually shut off from the pump suction chamber 142 and communicated to the high pressure chamber 141. Accordingly, the first fluid pressure chamber 21 is selectively supplied with a pressure of the pump suction side or a pressure upstream of the metering orifice 136 provided within the pump discharge passage 135.

A relief valve 152 is provided inside the spool 138, and opened to cause the fluid pressure to escape to the side of the tank, if the pressure within the spring chamber 144 (pressure downstream of the metering orifice 136, or the working pressure of the power steering device PS) is increased to exceed a predetermined value.

Further, the variable displacement pump 101 according to this embodiment, positions of the suction opening 32 and discharge opening 33 formed in the side plate 7 are shifted in a rotational direction, in contrast to the constitution according to the related art.

Figure 3:
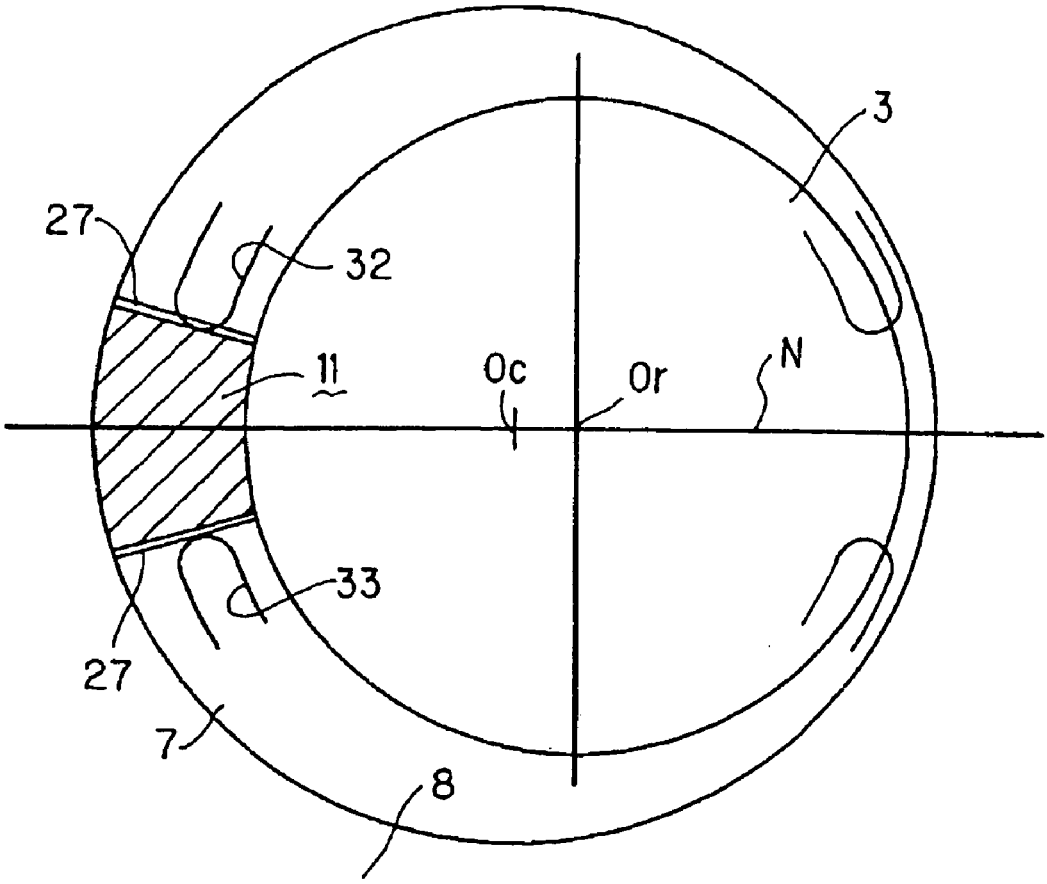
FIG. 3 is a view for explaining the positional relation of rotor and cam ring with respect to discharge opening and suction opening for a conventional variable displacement pump.

As a fundamental constitution of the variable displacement pump, a center Or of the rotor 3 (a shaft center of the drive shaft 25) and a center Oc of the cam ring 8 are located on the same horizontal line N, and the pump chamber 11 has the maximal volume, when two vanes 27, 27 provided in the rotor 3 are symmetrical vertically with respect to this horizontal line N, as shown in FIG. 3. The pump chamber 11 is switched from the suction opening 32 to the discharge opening 33 in a state with the maximal volume.

Figure 4:
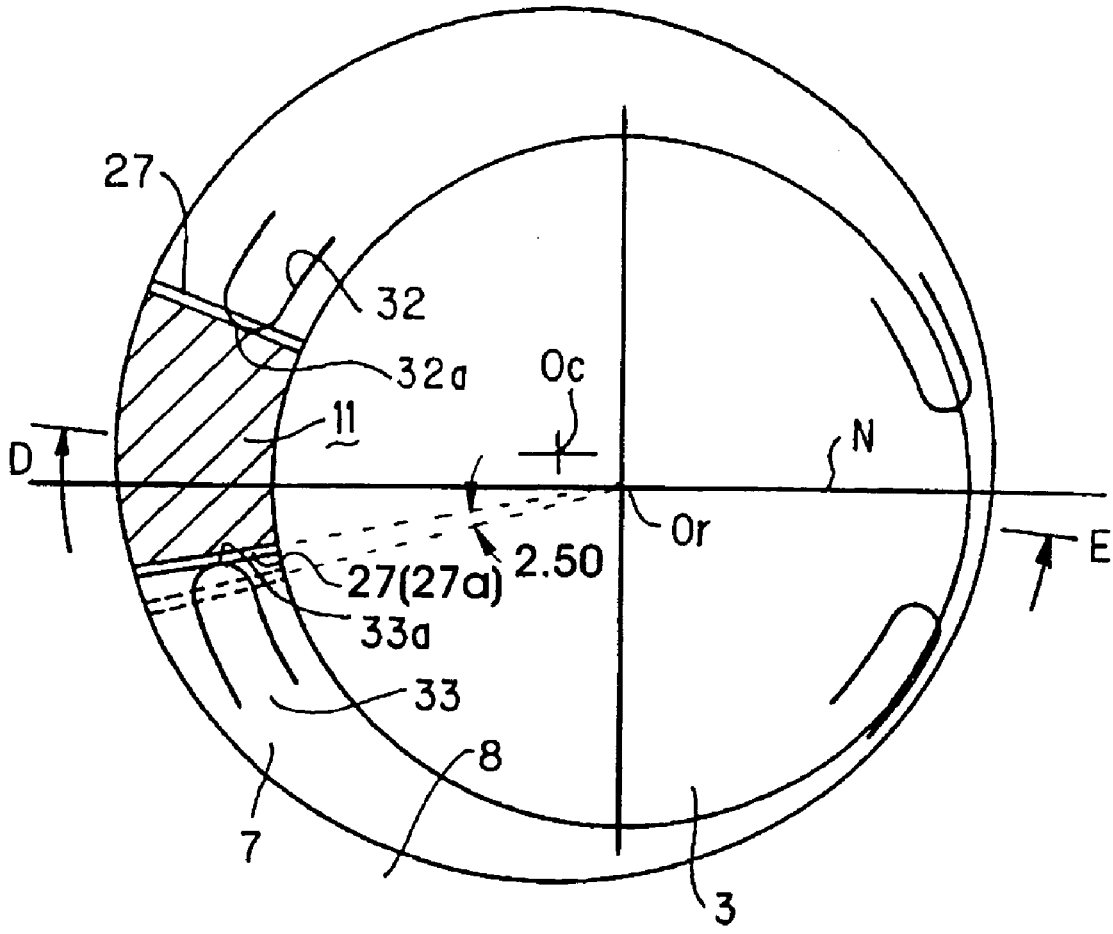
FIG. 4 is a view for explaining the positional relation of rotor and cam ring with respect to discharge opening and suction opening for the variable displacement pump according to the embodiment of the invention.

On the contrary, with the constitution of this embodiment, the side plate 7 formed with the discharge opening 33 and the suction opening 32 is rotated clockwise about 2.5°, and the center Oc of the cam ring 8 is shifted slightly upward from the horizontal line N passing the center Or of the rotor 3, as shown in FIG. 4. Accordingly, the pump chamber 11 formed by two adjacent vanes 27, 27 has the maximal volume before getting to a symmetrical position with respect to the horizontal line N. At the time when the volume of the pump chamber 11 is at maximum, this pump chamber 11 is connected to a terminal end portion 32*a* of the suction opening 32, and does not get to a start end portion 33*a* of the discharge opening 33. Hence, at the time when a preceding vane 27 (indicated by numeral 27*a* in FIG. 4) of two vanes 27 forming the pump chamber 11 gets to the start end portion 33*a* of the discharge opening 33, the pump chamber 11 has already started to be compressed. Namely, precompression is made.

The suction opening 32 and the discharge opening 33 are shifted in the rotation direction, as previously described, while the cam ring 8 is slightly lifted from the suction opening 32. Therefore, a high pressure is exerted over a range from D to E in FIG. 4 on the inner face of the cam ring 8 when the pump is in operation. Accordingly, the cam ring 8 is always subjected to an internal pressure to return to a position (on the side of the first fluid pressure chamber 21) where the volume of the pump chamber 11 is at maximum.

Figure 5:
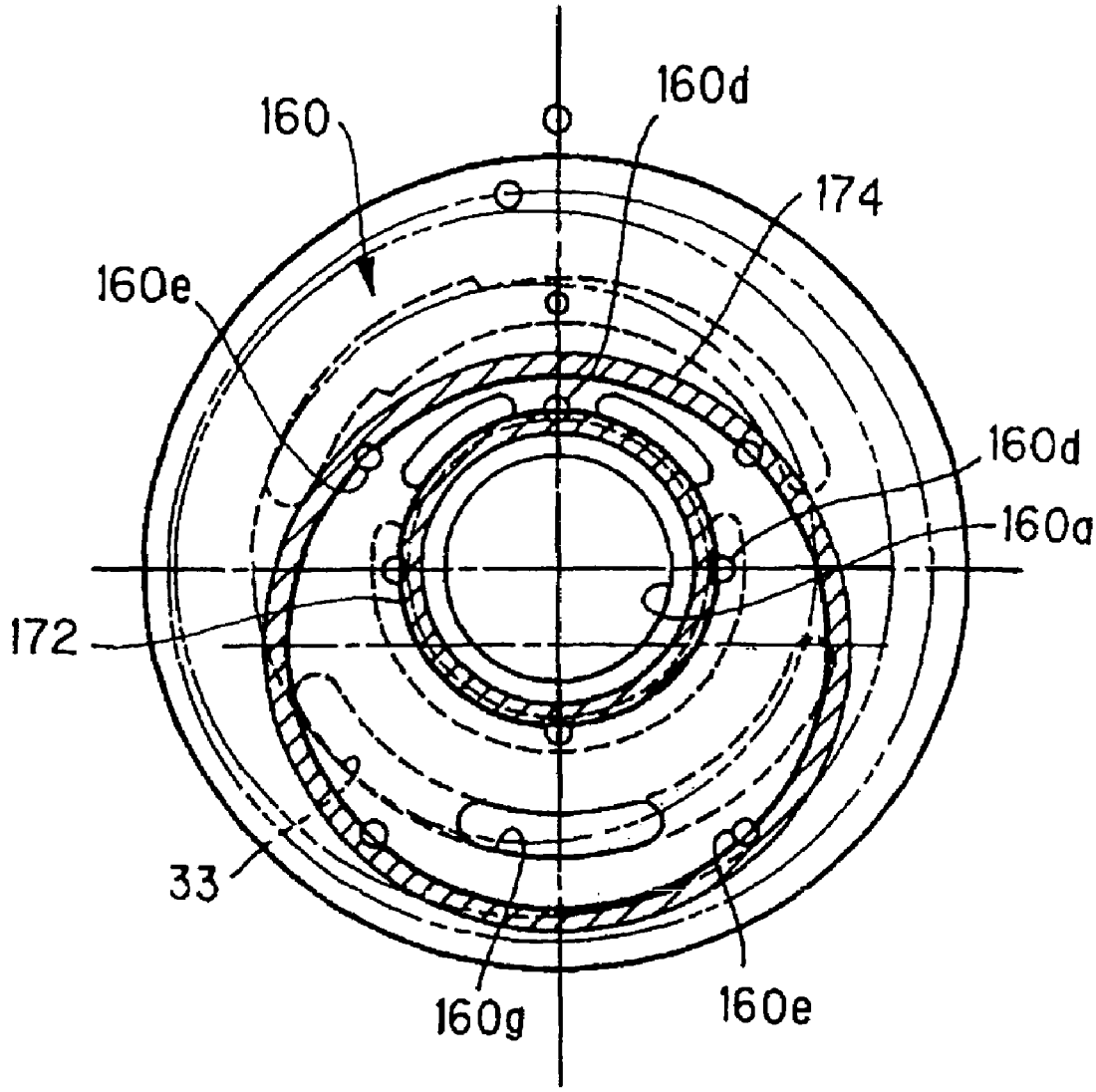
FIG. 5 is a front view showing the constitution of a seal portion provided on the side face of a pressure plate for the variable displacement pump.

Moreover, in the variable displacement pump 101 of this embodiment has two seal rings 172 and 174 fitted on the face of the pressure plate 160 on the side of the read body 5, as shown in FIG. 5. These seal rings 172 and 174 are made of resin, in this embodiment. An inner circumferential seal ring (first seal ring) 172 is disposed around a bore 160*a* through which the drive shaft 25 is passed. Also, an outer circumferential seal ring (second seal ring) 174 surrounds the outside of the discharge opening 33 formed in the side plate 7 in the discharge area (lower area in FIG. 5), and is disposed at the position proximate to the first seal ring 172 in the suction area.

Figure 6:
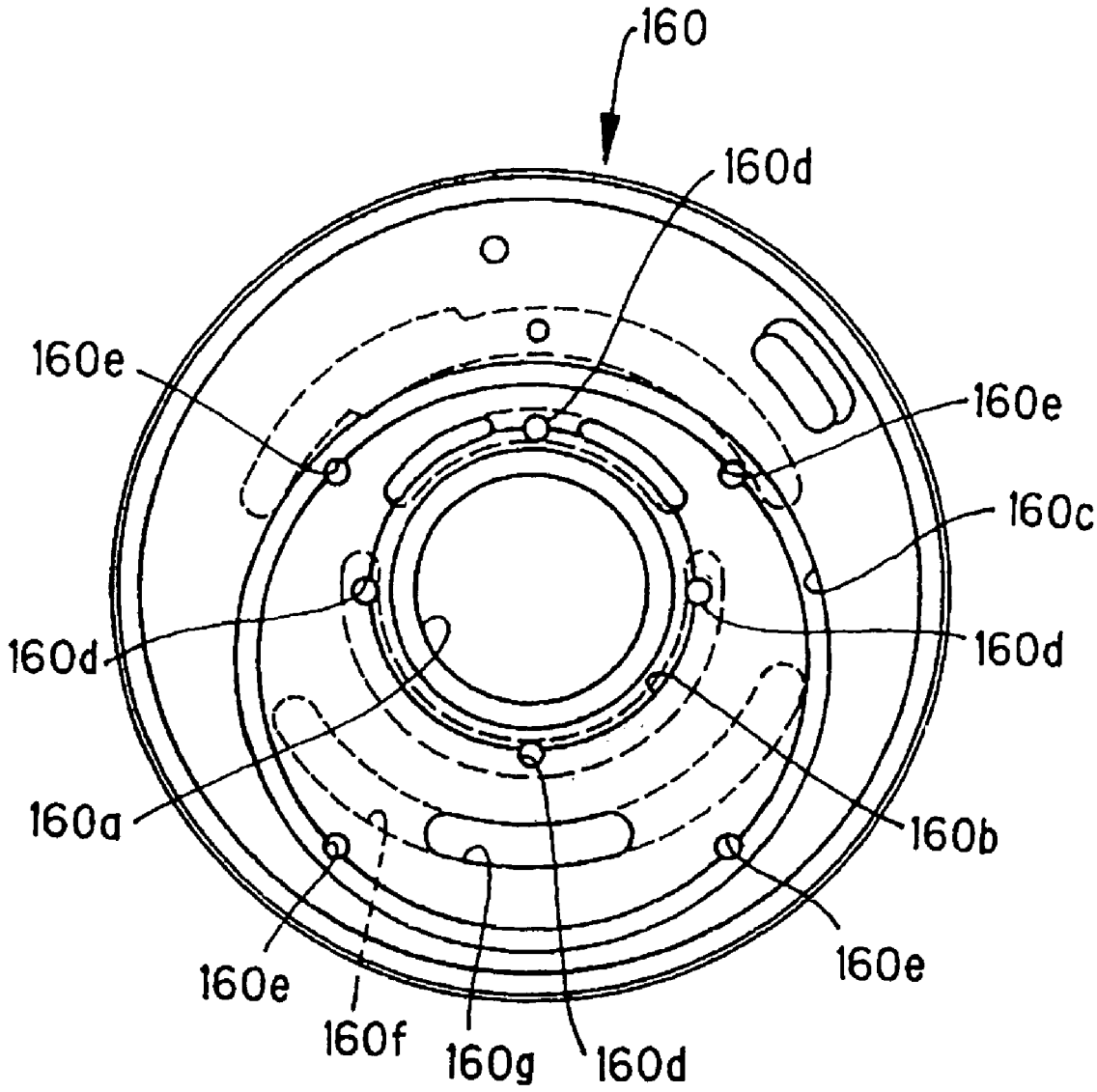
FIG. 6 is a front view of the pressure plate.
Figure 7:
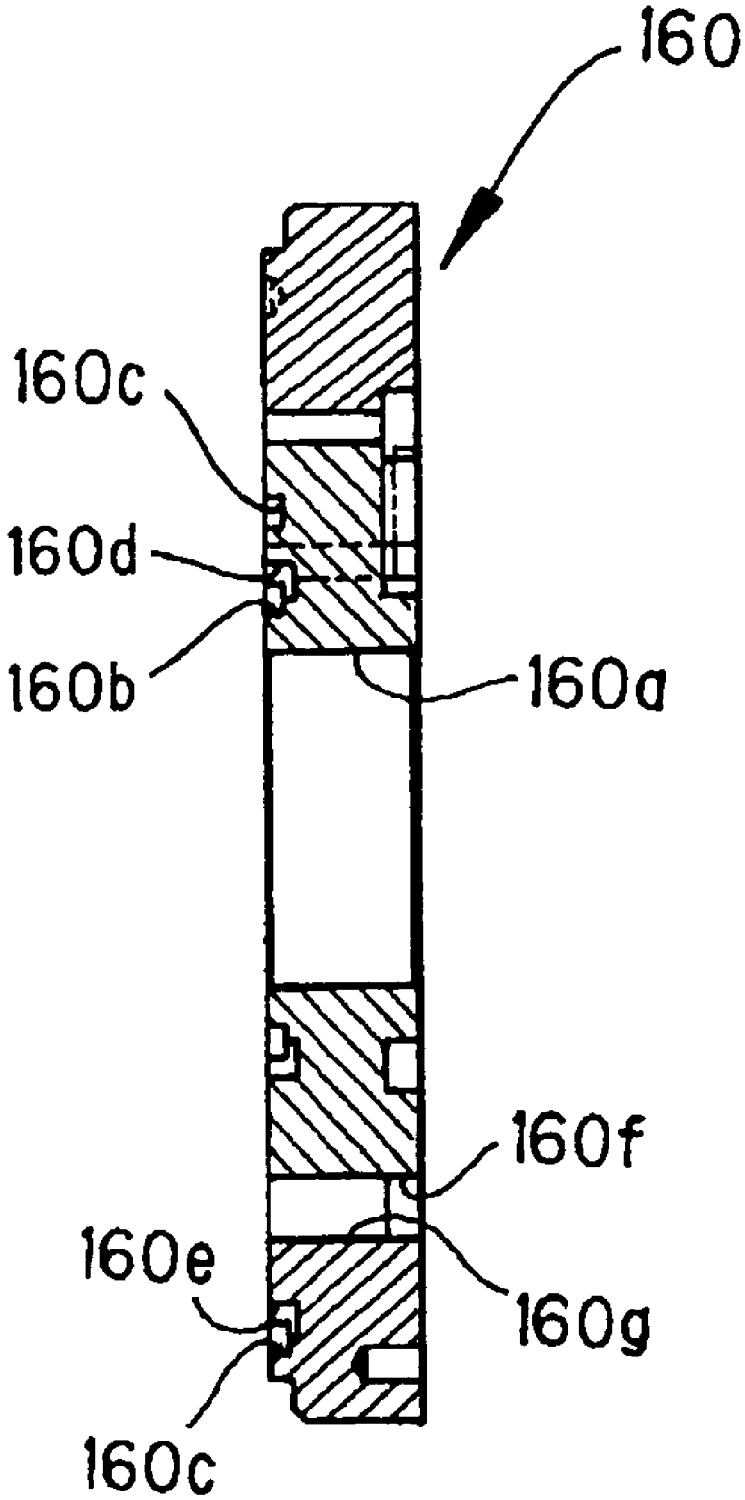
FIG. 7 is a longitudinal cross-sectional view of the pressure plate.

On the face of the pressure plate 160 on the side of the rear body 5, a first annular groove (seal groove) 160*b* and a second annular groove 160*c* for fitting the first seal ring 172 and the second seal ring 174 respectively are formed, as shown in FIGS. 6 and 7. Furthermore, the first annular groove 160*b* for fitting the first seal ring 172 has circular concave portions 160*d* having the diameter almost equal to the width of the groove 160*b* formed at regular intervals in the circumferential direction and at four positions shifted outside the groove 160*b* by about half of its diameter. Also, the second annular groove 160*c* for fitting the second seal ring 174 has circular concave portions 160*e* having the diameter almost equal to the width of the groove 160*c* formed at regular intervals in the circumferential direction and at four positions shifted inside the groove 160*c* by about half of its diameter. These circular concave portions 160*d* and 160*e* are deeper than the seal grooves 160*b* and 160*c* to introduce a high pressure oil into the circular concave portions 160*d*, 160*e* , and support the seal rings 172 and 174 from the back side, whereby the blow-by, or the pressure oil passing over the seal rings 172, 174 due to impaired seal function is prevented.

The pressure plate 160 is formed with a circular groove 160*f* and a through hole 160*g* at the position corresponding to the discharge opening 33 formed in the side plate 7, whereby pump discharge pressure is introduced between the seal rings 172 and 174 on the face of the pressure plate 160 on the side of the rear body 5.

A pump discharge pressure is exerted over a portion with the discharge opening 33 formed and its periphery on the face of the side plate 7 on the side of the front body 4, whereby the area of the portion surrounded by both the seal rings 172, 174 of the pressure plate 160 is larger than the area of the side plate 7 where discharge pressure is exerted. Accordingly, when the pump is in operation, the pressure plate 160 presses the rotor 3, the cam ring 8 and the adapter ring 9 toward the side plate 7 to reduce a side clearance of the rotor 3, the cam ring 8 and the adapter ring 9 with respect to the side plate 7 and the pressure plate 160 on its both sides. In particular, when the pump discharge pressure is higher, the pressure plate 160 presses them toward the side plate 7 more strongly to reduce the side clearance and prevent loss due to internal leakage.

The operation of the variable displacement pump 101 of the above constitution will be described below. When the pump is stopped, the control valve is not subjected to hydraulic pressure, so that the spool 138 of the control valve 123 is stopped against the plug 168 as stopper due to a resilient force of the compression coil spring 145. In this state, if the engine is started, the rotating speed of the variable displacement pump 101 is increased if the engine speed is higher.

While the engine speed is slow, the spool 138 of the control valve 123 is stopped at a position as indicated in FIG. 2 by the compression coil spring 145, because there is a small pressure difference between the upstream side and the downstream side of the metering orifice 136. When the control valve 123 is not in operation, a pressure on the pump suction side is introduced from the pump suction chamber 142 of the control valve 123 via the connecting passages 2*a*, 9*a* into the first fluid pressure chamber 21 on the left of the cam ring 8, while a pressure on the pump suction side is introduced via the inlet bore 170 into the second fluid pressure chamber 22 on the right of the cam ring 8. Accordingly, the cam ring 8 is held at the position where the volume of the pump chamber 11 is at maximum by the spring 17, as shown in FIG. 2, and this variable displacement pump 101 has the discharge flow rate increased in proportion to the rotating speed (see the range from A to B in FIG. 13).

As the engine speed is higher, the discharge flow rate from the pump chamber 11 is gradually increased, making larger the pressure difference between the upstream side and the downstream side of the metering orifice 136, and if this pressure difference is beyond a predetermined amount, the spool 138 is moved in a direction of flexing the compression coil spring 145 (direction toward the spring 144). And the spool 138 is balanced at a predetermined position and kept in this state. Then, the spool 138 is almost stabilized in a state where the pump suction side is connected or can be connected to the first fluid pressure chamber 21 formed on one side portion (on the left in FIG. 2) of the cam ring 8.

In an equilibrium state of the spool 138 for this control valve 123, the cam ring 8 is swung on the right of FIG. 2, owing to a differential pressure between the fluid pressure chambers 21 and 22 on both sides and a biasing force of the compression coil spring 17, and balanced at a position where the pump discharge flow rate of the pump chamber 11 is at minimum. In this state, when the pump discharge pressure is 150 kg/cm$^2$, for example, the cam ring 8 is balanced at a hydraulic pressure of the first fluid pressure chamber 21 of about 150 kg/cm$^2$, whereby there is no risk of internal leakage even without working the seal 24 at high precision.

In the equilibrium state, if a steering operation is performed, the working pressure of the power steering device PS is increased, and put via the passage 151 into the spring chamber 44 of the control valve 123 to act on the end face of the spring chamber 144 for the spool 138. If the spool 138 is pushed back on the left of FIG. 1 owing to working pressure of the power steering device PS, the first fluid pressure chamber 21 on the left of the cam ring 8 is shut off from the high pressure chamber 141 into which an upstream pressure of the metering orifice 136 is introduced and connected to the pump suction chamber 142. The fluid pressure chambers 21 and 22 on both sides of the cam ring 8 are at the pressure on the pump suction side, so that the cam ring 8 is swung in a direction of expanding the volume of the pump chamber 11 by the spring 17 on the second fluid pressure chamber 22 and a pressure acting on its inner circumference.

That is, in the variable displacement pump 101 of this embodiment, the positions of the suction opening 32 for supplying working oil to the pump chamber 11 and the discharge opening 33 for discharging working oil from the pump chamber 11 are shifted in rotational direction (clockwise direction in FIG. 2), as compared with the conventional variable displacement pump 1, so that a pressure (high pressure in a range from D to E in FIG. 4) acting on the inner face of the cam ring 8 is exerted to return the cam ring 8 to the position as indicated in FIG. 2. Accordingly, even if the second fluid pressure chamber 22 is always at the pressure on the pump suction side, the cam ring 8 is rapidly returned in the direction of expanding the volume of the pump chamber 11 to increase the discharge flow rate.

Figure 13:
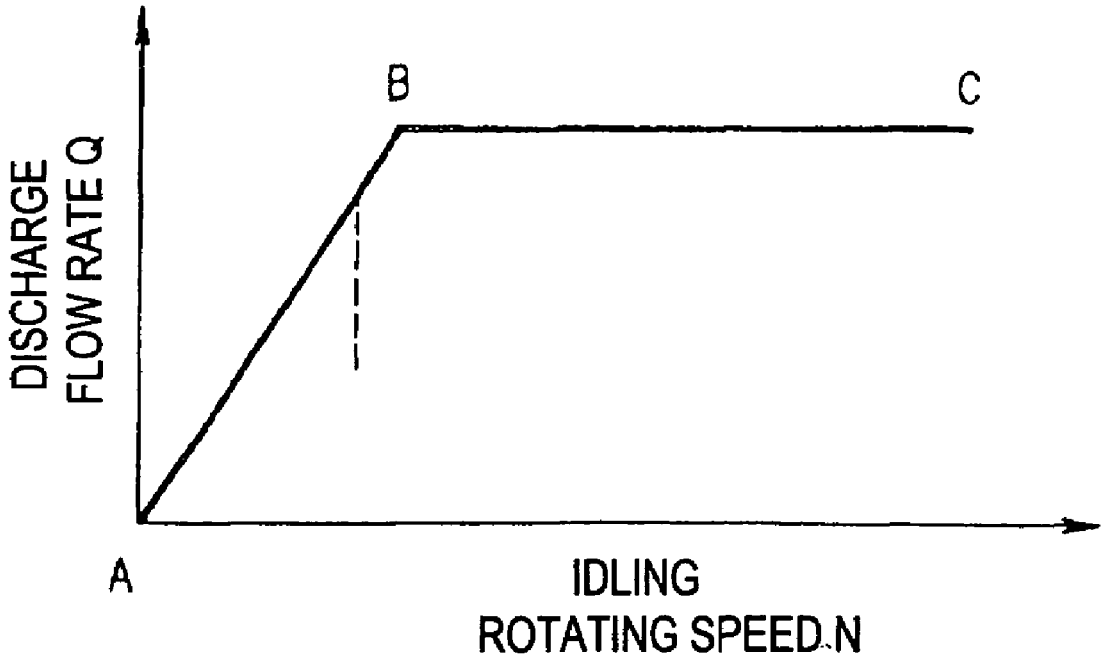
FIG. 13 is a graph showing the relation between the pump discharge flow rate and the rotating speed.

With the constitution of the conventional variable displacement pump (JP-A-6-200883), a pump discharge pressure (upstream pressure of the metering orifice 136) is directly applied on the second fluid pressure chamber 22 in an area from A to B in FIG. 13, bringing about a risk of internal leakage, whereby to prevent internal leakage, it is required to have a high working precision for the seal portion, including the inner diameter of the pump body 2 or the outer diameter of the adapter ring 9, and the pump is difficult to use for high pressures. However, with the constitution of this embodiment, it is unnecessary to have a high working precision for the seal portion, whereby the internal leakage can be improved. Also, the vibration sound due to pulsation can be improved. Furthermore, the pump can be used for high pressures without increasing the size of the pump body 2 for greater strength.

The variable displacement pump as disclosed in JP-A-2002-98060 as invented by the present inventor and filed ahead can solve the above-mentioned problems associated with the conventional variable displacement pump. However, since a high pressure is momentarily applied on the second fluid pressure chamber in activating the spool of the control valve, there is a fear of internal leakage at that moment. On the contrary, with the constitution of the embodiment of this invention, since a pressure on the pump suction side is always introduced into the second fluid pressure chamber 22, it is more beneficial to cope with the higher pressures for the pump. And in the invention of the above patent, the connecting passage for connecting the control valve and the second fluid pressure chamber is provided, but in this embodiment, there is no need for the connecting passage (hydraulic hole formed in the pump body 2 and the adapter ring 9) between the control valve 123 and the second fluid pressure chamber 22, whereby the number of working steps can be reduced with the cost down.

Referring to FIG. 2, a second embodiment will be described below. In this figure, the dashed line indicates the position of the rotor 3, and the solid line indicates the position of the cam ring 8A, when the pump discharge volume is at maximum, and the broken line indicates the position of the cam ring 8B when the pump discharge volume is at minimum. In the first embodiment as previously described, the discharge opening 33 and the suction opening 32 formed in the side plate 7 are shifted in rotational direction, and the cam ring 8 is made slightly eccentric to the side of the suction opening 32 (upward in FIGS. 2 and 4) to apply an internal pressure on the cam ring 8 in a direction where the cam ring 8 is swung toward the first fluid pressure chamber 21. However, in this embodiment, the positions of the discharge opening 33 and the suction opening 32 may be symmetrical vertically as in the conventional constitution. In this embodiment, the parts, not shown, are also described with the same numerals as with the constitution of the first embodiment.

Figure 8:
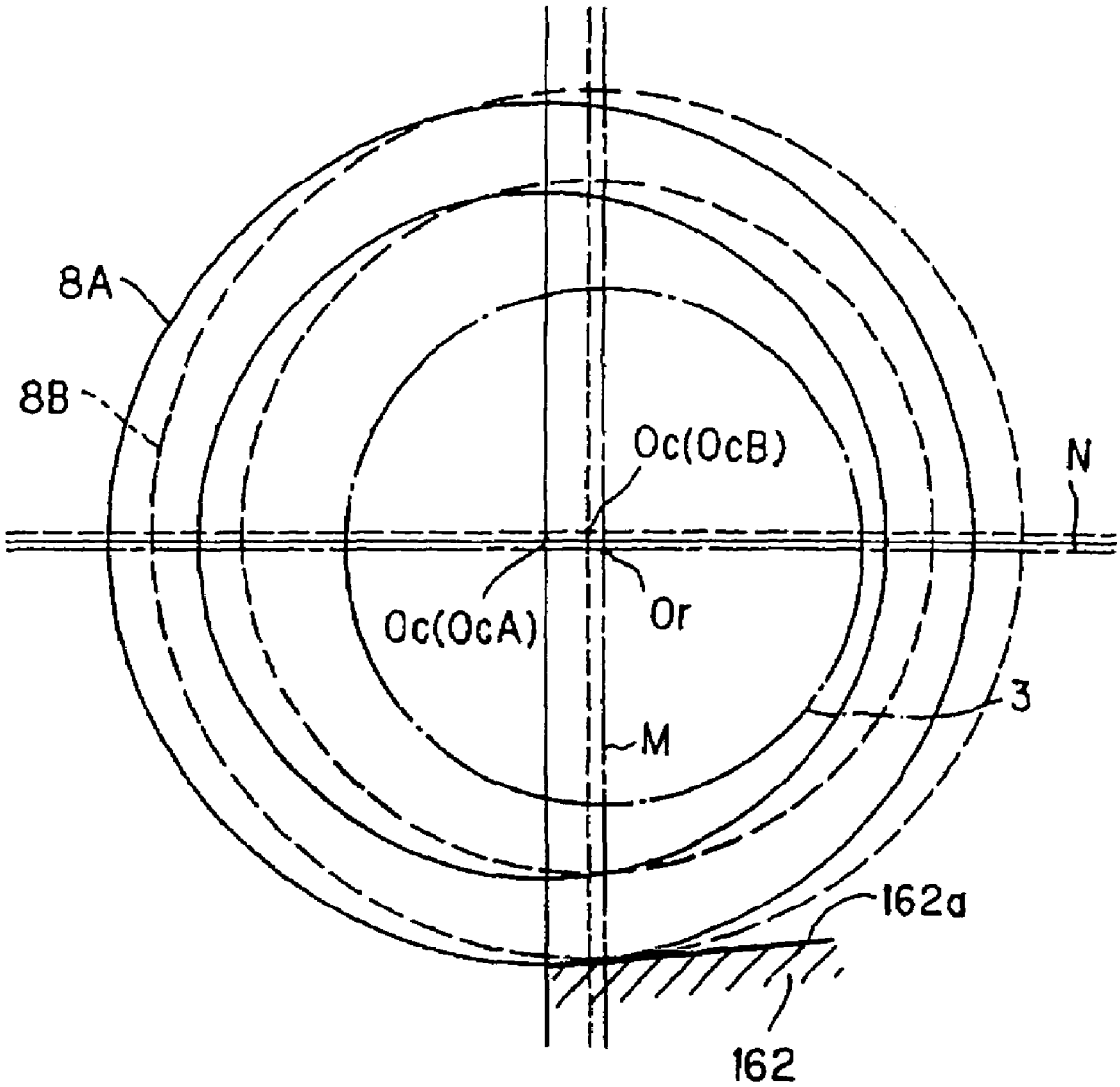
FIG. 8 is a view for explaining the positional relation of rotor and cam ring with respect to a rolling fulcrum of the cam ring for a variable displacement pump according to a second embodiment of the invention.
Figure 9:
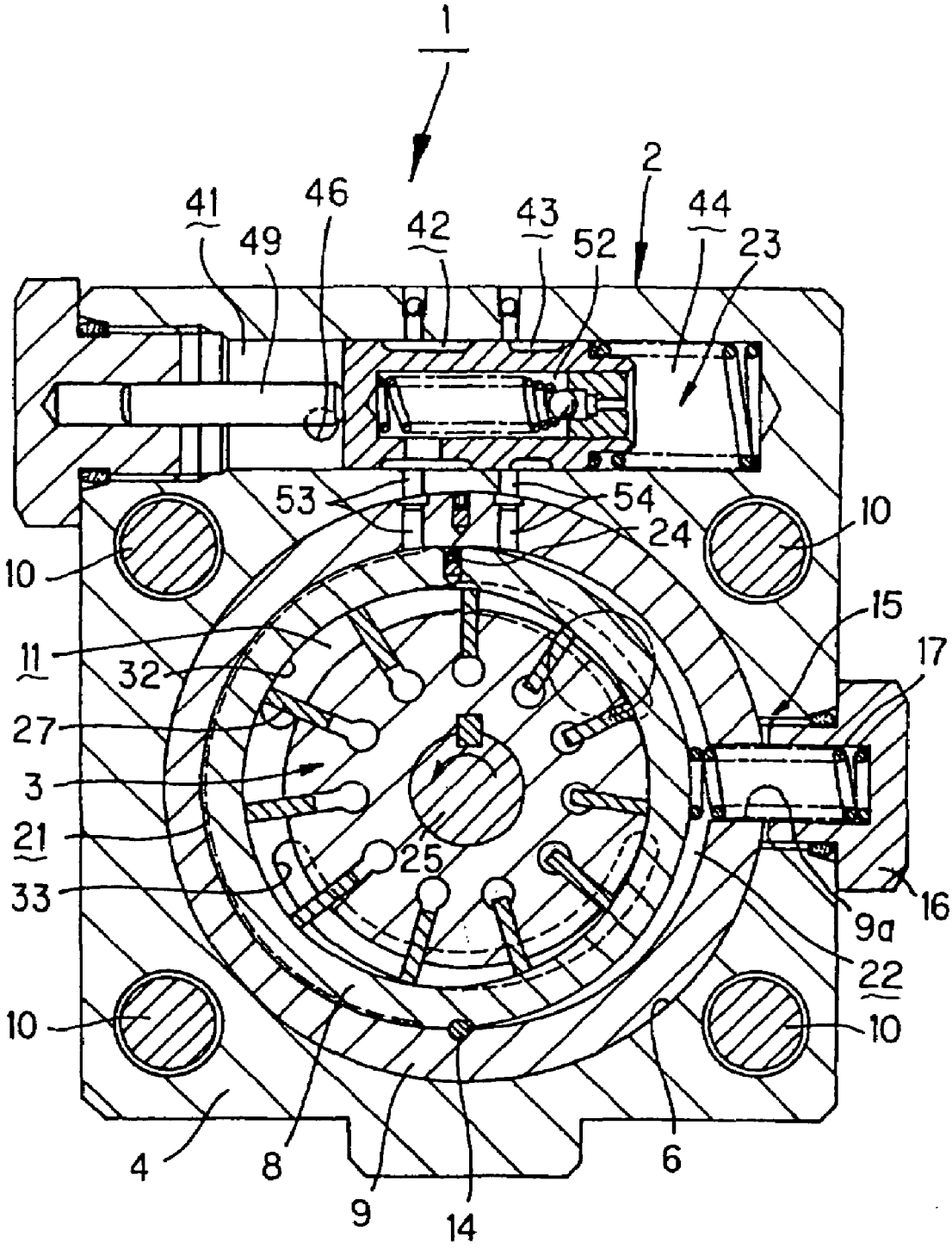
FIG. 9 PRIOR ART
FIG. 9 is a cross-sectional view of the conventional variable displacement pump, taken perpendicularly to the axial line of the drive shaft.
Figure 10:
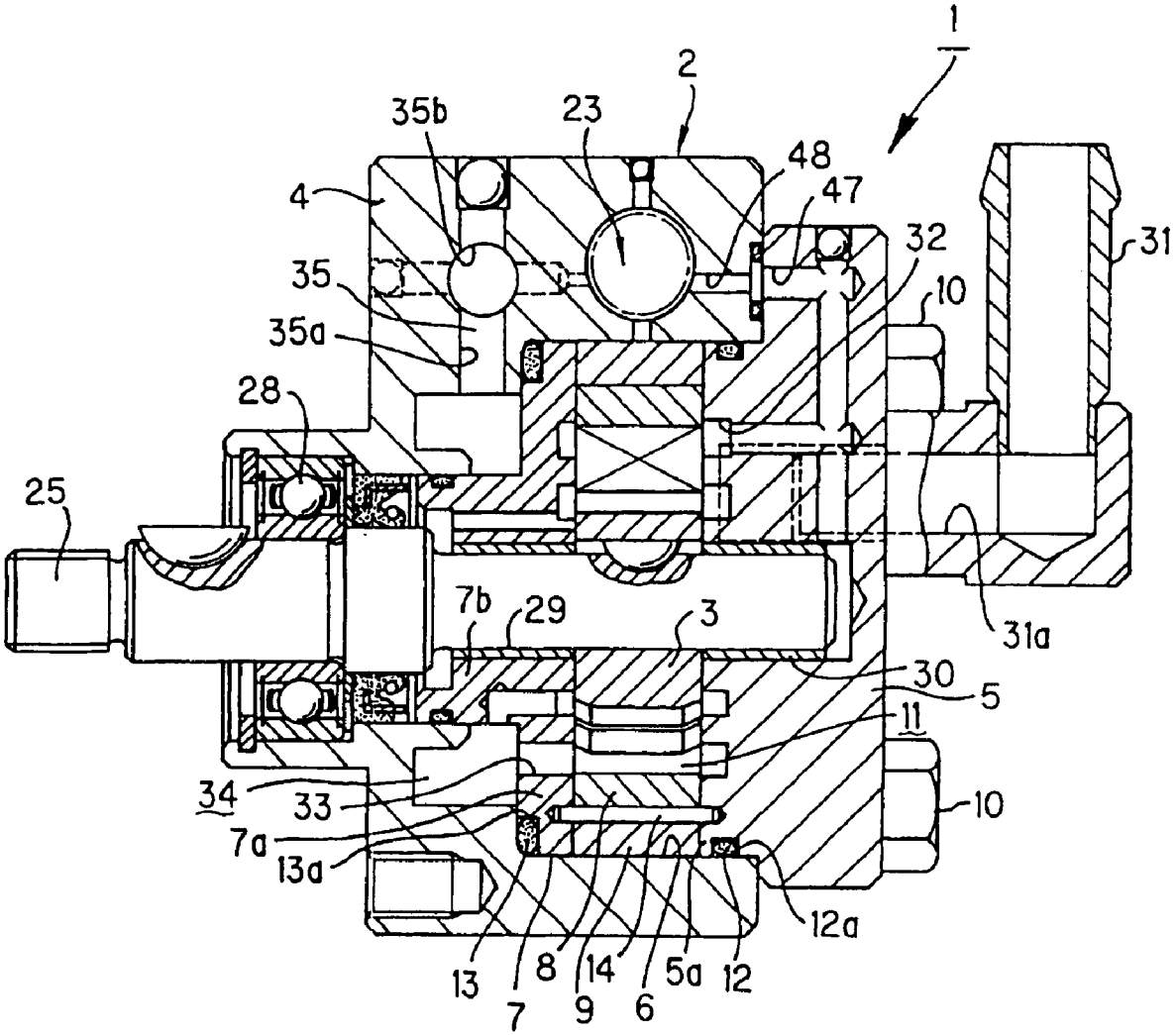
FIG. 10 PRIOR ART
FIG. 10 is a cross-sectional view of the conventional variable displacement pump taken along the axial line of the drive shaft.
Figure 11:
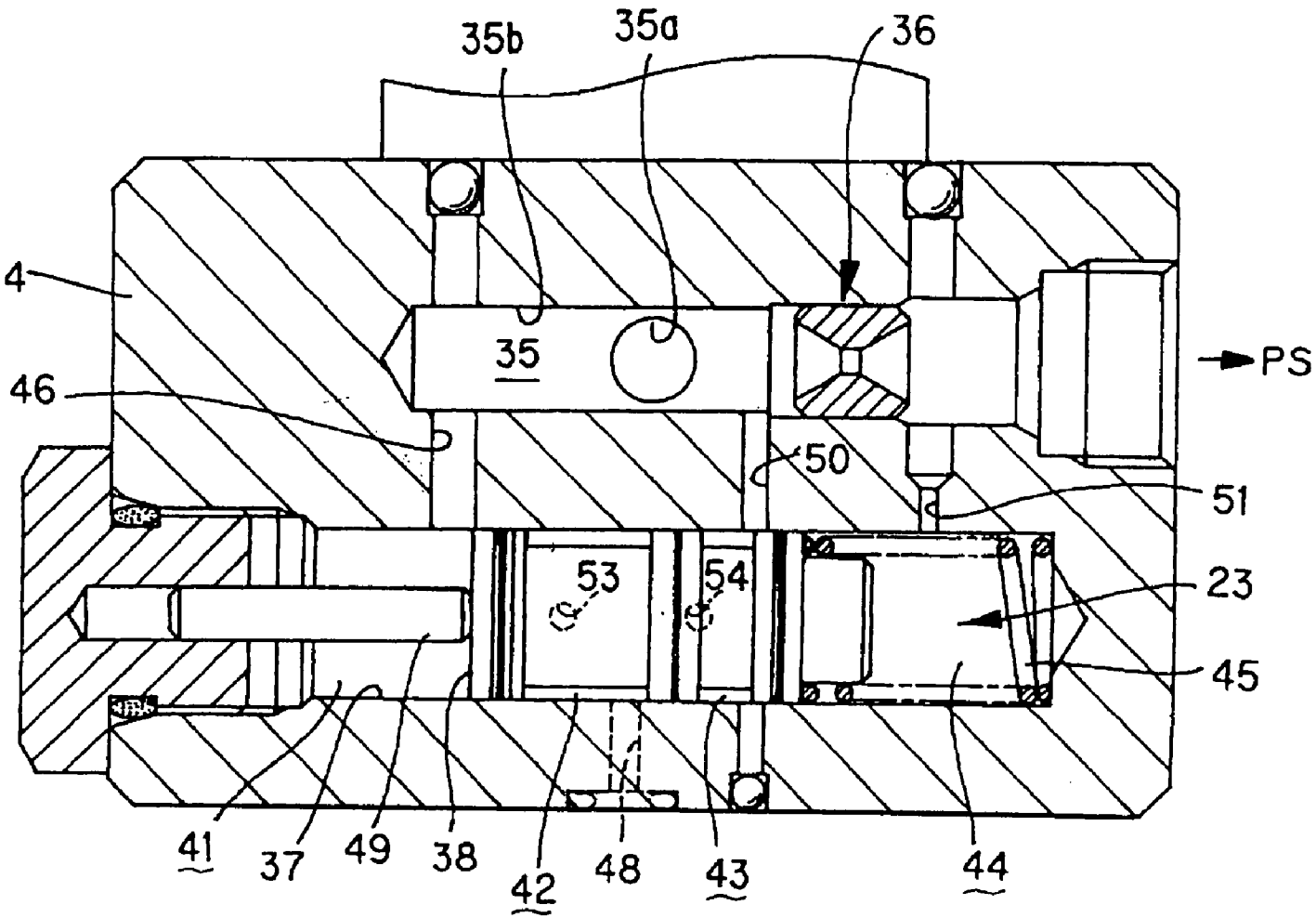
FIG. 11 PRIOR ART
FIG. 11 is across-sectional view showing the constitution of a control valve and a discharge passage for the conventional variable displacement pump.
Figure 12:
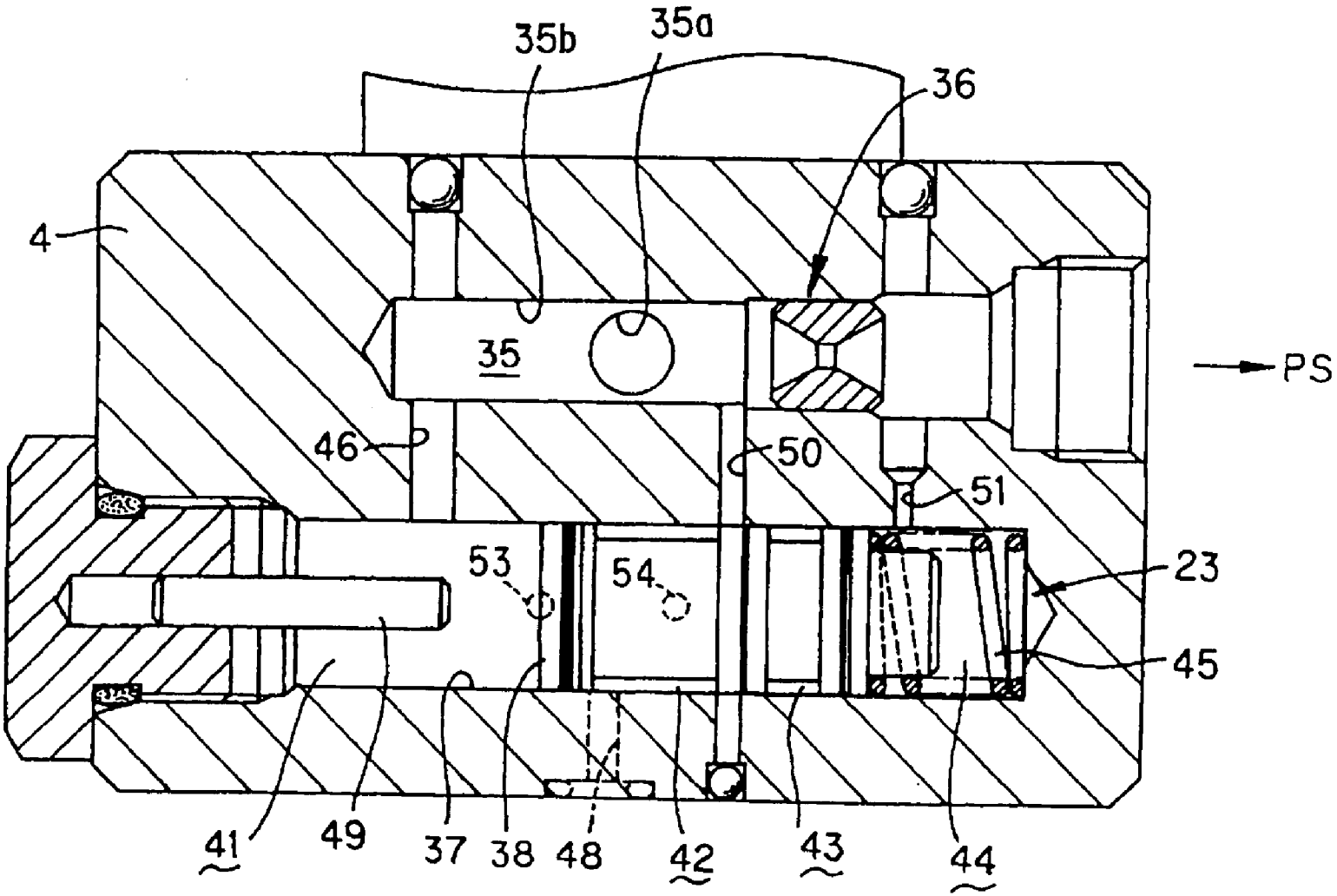
FIG. 12 PRIOR ART
FIG. 12 is across-sectional view showing the constitution of the control valve and the discharge passage for the conventional variable displacement pump in an active state different from that of FIG. 11.

In this embodiment, the support plate 162, disposed on the inner face of the adapter ring 9, for supporting the cam ring 8 is shifted toward the second fluid pressure chamber 22 (on the right in FIG. 8) with respect to the vertical line M passing through the center Or of the rotor 3, and its rolling support face 162*a* is inclined toward the first fluid pressure chamber 21 (on the left in FIG. 8). The center Oc of the cam ring 8 (that is indicated by OcA when the pump discharge volume is at maximum or OcB when it is at minimum) is located slightly above the horizontal line N passing through the center Or of the rotor 3.

The constitution for other parts is the same as in the first embodiment. When the cam ring 8 is swung in a direction of decreasing the pump discharge volume (on the right in FIG. 1), the pump discharge pressure is controlled to be introduced into the first fluid pressure chamber 21. Conversely, when the cam ring 8 is returned in a direction of increasing the pump discharge volume (on the left in FIG. 1), a swinging fulcrum 12 of the cam ring 8 is placed closer to the second fluid pressure chamber 22 than the shaft center Or of the rotor 3, and inclined toward the first fluid pressure chamber 21, whereby if a resultant force of the cam ring internal pressures due to pump discharge pressure is exerted perpendicularly on the rolling support face 162*a*, its component force is exerted toward the first fluid pressure chamber 21, so that the cam ring 8 is rapidly returned owing to the internal pressures of this cam ring 8 in addition to a force of the spring 17. In this embodiment, the second fluid pressure chamber is connected to the pump suction side at anytime, thereby improving the internal leakage, and the position of the swinging support face of the cam ring is on the side of the second fluid pressure chamber, whereby when it is required to increase the pump discharge flow rate, the cam ring can be rapidly returned.

This invention is not limited to the structure as described in this embodiment, but various modifications may be made without departing from the spirit and scope of the invention as defined by the appended claims. For example, the angle for rotating the discharge opening or the suction opening of the first embodiment and the shift position of the rolling support face of the cam ring of the second embodiment are not limited to those of the above embodiments, but may be appropriately selected.

As described above, the variable displacement pump of this invention has a control valve to be activated due to a pressure difference between the upstream and downstream sides of the metering orifice, in which the first fluid pressure chamber is connected to the control valve to control a fluid pressure within the first fluid pressure chamber, and the second fluid pressure chamber is shut off from the control valve and connected to a pump suction side at any time, and an internal pressure of the cam ring is applied in a direction where the cam ring is swung toward the first fluid pressure chamber. Thereby, it is possible to improve internal leakage and prevent the pump efficiency from decreasing. Moreover, in addition to a spring force, an internal pressure of the cam ring is applied toward the first fluid pressure chamber, so that the cam ring can be rapidly returned to the side for increasing the volume of pump chamber.

Also, in the variable displacement pump according to the invention, a discharge opening for discharging a pressure fluid from a pump chamber is provided on one of two plates for carrying the cam ring, a first seal ring surrounding a drive shaft for driving the rotor and a second seal ring on the outer circumference of the first seal ring and surrounding a wider region than a region where the discharge opening is disposed are provided on the rear face of the other plate, and an inlet passage for introducing a discharge pressure is formed in an area between both seal rings. Thereby, when the pump is in operation, one of the two plates for carrying the cam ring and the rotor is pressed onto the other plate, making it possible to reduce the internal leakage.

What is claimed is:

1. A variable displacement pump comprising:

a cam ring carried swingably between plates on both sides;

a first fluid pressure chamber formed in one of the swing directions of the cam ring;

a second fluid pressure chamber provided in the other swing direction of the cam ring;

urging means for urging the cam ring toward the first fluid pressure chamber, disposed on a side of the second fluid pressure chamber;

a rotor eccentrically disposed within the cam ring and having a plurality of vanes on an outer circumference thereof;

a metering orifice disposed halfway on a discharge passage of a pressure fluid discharged from a pump; and a control valve activated by a pressure difference between upstream and downstream sides of the metering orifice, wherein a fluid pressure in at least one of the first and second fluid pressure chambers is controlled by activation of the control valve to swing the cam ring;

wherein a discharge opening for discharging a pressure fluid from a pump chamber is disposed on one of the plates for carrying the cam ring;

wherein a first seal ring surrounding a drive shaft for driving the rotor and a second seal ring on an outer circumference of the first seal ring, surrounding a wider region than a region where the discharge opening is disposed are provided on a rear face of the other plate; and wherein an inlet passage for introducing a discharge pressure is formed in an area between the first and second seal rings.

2. The variable displacement pump according to claim 1, wherein the first and second seal rings are made of resin;

wherein the first and second seal rings communicate to seal grooves to which the seal rings are fitted;

wherein concave portions, which are deeper than the seal grooves, are formed to introduce a discharge pressure thereinto.

* * * * *